United States Patent [19]

Russell

[11] 4,039,903

[45] Aug. 2, 1977

[54] REMOTE CONTROLLED MECHANICAL RELEASE OR LOCK-IN ELECTRICAL PATH BETWEEN BATTERY AND A LOAD

[76] Inventor: Carl D. Russell, 1502 S. Boulder 24D, Tulsa, Okla. 74119

[21] Appl. No.: 550,823

[22] Filed: Feb. 18, 1975

[51] Int. Cl.[2] ..... H01H 9/00; H01H 47/00

[52] U.S. Cl. ..... 361/187; 307/10 BP

[58] Field of Search ..... 317/31, 157; 307/10 BP, 307/10 LS, 10 R

[56] References Cited

U.S. PATENT DOCUMENTS

| | | | |
|---|---|---|---|
| 1,950,194 | 3/1934 | Samad | 307/10 BP |
| 2,862,148 | 11/1958 | Weigl et al. | 307/10 BP X |
| 3,407,306 | 5/1968 | Huntzinger | 317/157 |
| 3,760,236 | 9/1973 | Hollins | 307/10 BP X |
| 3,772,568 | 11/1973 | Phillips | 317/31 X |
| 3,903,429 | 9/1975 | Heffel | 307/10 BP |

*Primary Examiner*—R. N. Envall, Jr.

[57] ABSTRACT

The invention in a vehicle senses battery voltage level when the key is in the 'off' position and disconnects the battery if its voltage level falls to a predetermined voltage. This level permits restarting of the vehicle although the lights have been inadvertently left on or a short has occurred. It provides for a unique remote controlled mechanical lock-in of the electrical current path from the battery to a load and a mechanical lock-out on the voltage sensing interrupting circuit when the ignition switch is in 'on' position and the reestablishment of the voltage level control to magnetically provide the electrical current path from the battery to the load when the ignition switch is returned to 'off' position thus obligating the voltage level control circuit to retain the path from the battery to the load until the battery decays to a predetermined level. This discontinues the current to the load. By returning the ignition switch to 'on' the electrical current path is reestablished.

7 Claims, 5 Drawing Figures

REMOTE CONTROLLED MECHANICAL RELEASE OR LOCK-IN ELECTRICAL PATH BETWEEN BATTERY AND A LOAD

The prior art upon which the present invention improves is U.S. Pat. No. 3,462,647 issued Aug. 19, 1969 and U.S. Pat. No. 3,623,131 filed May 19, 1970 and U.S. Pat. No. 3,732,752 issued Mar. 27, 1973 all invented by the present applicant. These patents relate to vehicular voltage level sensing and battery disconnect but the present invention improves thereover with such features as steering wheel mounting, mechanical lock-in of the vehicle electrical current path when the key is 'on,' automatic reset when the key is switched from 'on' to 'off,' and magnetic hold-in when the key is 'off' for ready sensing and release.

The present invention comprises an inexpensive apparatus to assure positive battery connection between the battery and the load at all times when the ignition switching mechanism is in 'on' position and also allows battery voltage sampling and interrupting of the electrical current path between the battery and the load when the ignition mechanism is in 'off' position.

Both functions are achieved through an unique arrangement to allow the ignition switch mechanism to remotely control and select when either function is to be operated. In 'on' position of the ignition switching mechanism, the electrical current path is mechanically locked and allows the current to be drained from the battery if the engine is not running or the alternator is not working. In the 'off' position there is maintained a voltage sensing circuit so that when the battery decays to a given level the electrical current path between the battery and the load is interrupted and cuts off the load and the sensing circuit. Once the ignition key is in the 'on' position and then is moved back to the 'off' position, the voltage sensing system has been energized and will provide electrical current path from the battery to the load as long as the ignition switching mechanism is in 'off' position or until the battery has decayed to a pre-set level, then the circuit is interrupted and electrical current paths are discontinued between the battery and the load and the battery and the voltage sensing circuit thereby stopping all drain upon battery until ignition switch is turned on.

The invention will be further described in connection with the embodiments thereof shown in the attached drawings wherein.

DESCRIPTION

Figure 1:
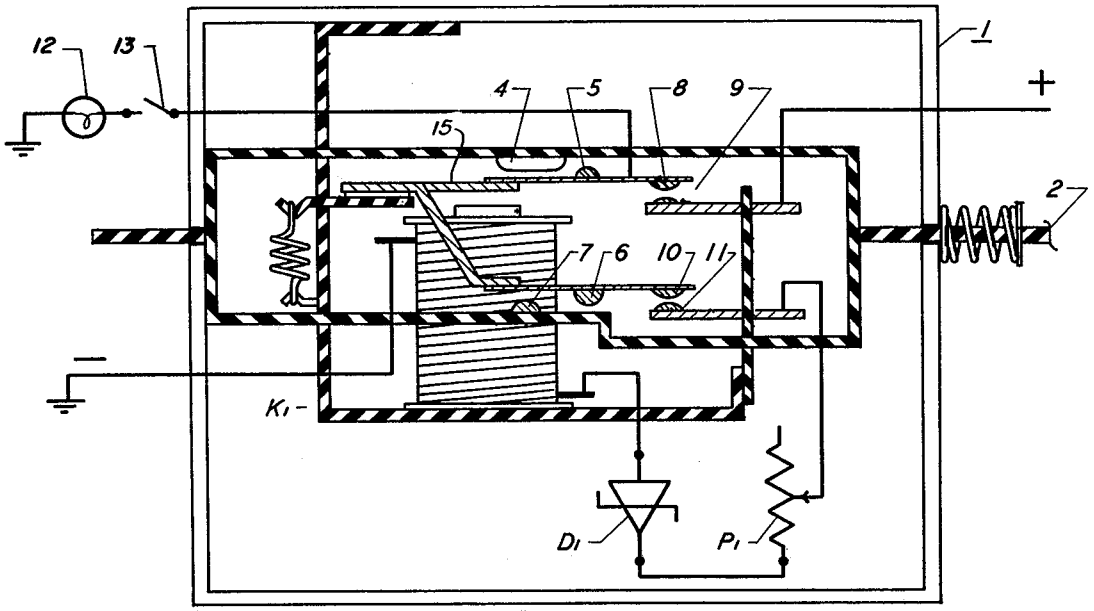
FIG. 1 shows the control apparatus for mounting on the steering wheel, spaced from the key, for opening and closing the vehicular electrical path in response to key position and voltage sensing.

FIG. 1 Enclosure 1 contains a double bar actuator 2 arrangement with lugs 4 and 7 suitably positioned to coordinate the opening and closing of he electrical current path (from plus to ground via contacts 8 and 9 and switch 13 and load 12) in unity with the ignition switch as operated by remote control. A dual spring tensioned electrical contact 8–9 and 10–11 needed for a respectively electrical current path from battery to the load 12 and an electrical current path from battery to the voltage level interrupting circuit is provided in FIG. 1 Potentiometer P1 and zenor diode P1 are connected in series in the electrical current path extending to relay K1 for adjustment of the predetermined voltage level at which the battery will be disconnected.

FIG. 2

This figure shows enclosure 1 of the invention secured to steering column 34 which has key lock 30 with rod 31 extending adjacent to steering column 34 to ignition switch 32. Connector arm 3 extends from rod 31 to spring 35 which is secured to actuator 2. This is the means by which the invention is actuated remotely by key lock 30.

FIG. 3

Figure 3:
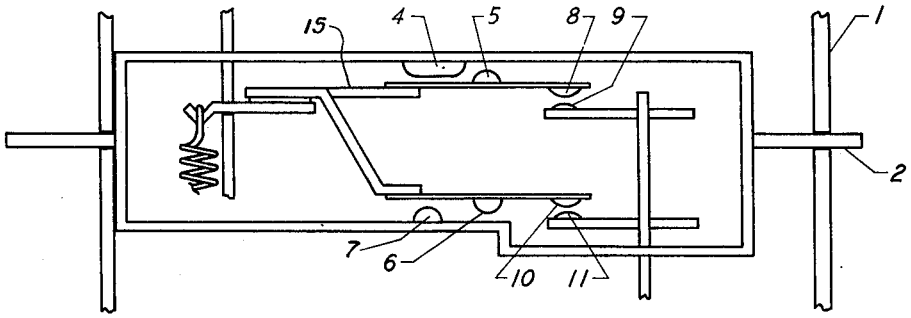
FIg. 3 is a detailed control apparatus view with the key in the 'off' position and the electrical path open as a result of sensing too low battery voltage level.

Shows a portion of the invention where actuator 2 is the means which by changing position from left to right and right back to left as a result of key position, affects the functioning of contact 8, 9, 10, and 11 providing electrical current pathways. Also, it shows actuator 2 in the extreme left hand position with actuator lug 4 withdrawn from contact arm 5 allowing contacts 8 and 9 to be openable, but relay K1 is energized when the key is moved from 'on' to 'off' (FIG. 4) which then closed the electrical current pathway between the battery and the load FIG. 3 shows the apparatus with the key 'off' and a low battery voltage which released relay K1 and opened contacts 8–9 and 10–11.

FIG. 4

Shows actuator lug 7 withdrawn from auxiliary contact 6 allowing contacts 10 and 11 to be closed, energizing relay K1 and closing or maintaining closed the electrial path between the battery and the voltage level control interrupting circuit by magnetically drawing contact 8 against contact 9.

Figure 2:
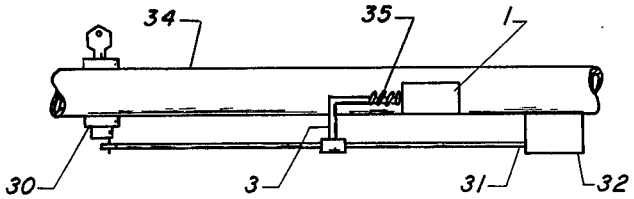
FIG. 2 shows the mounted apparatus with remote key lock connection.
Figure 4:
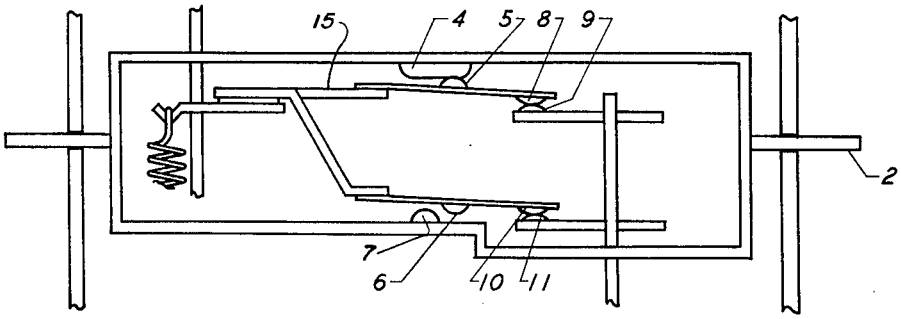
FIG. 4 shows the apparatus of FIG. 3 with the key being turned from 'on' to 'off' and the shifting of mechanical lock-in to magnetic maintaining of the electrical path contacts closed for sensing control; and, FIG. 5 shows the apparatus of FIG. 3 with the key 'on' and the electrical path locked-in mechanically.

FIG. 4 alternatively shows actuator 2 being moved downward (as seen in FIG. 2) by key lock 30 and rod 31 moved downward and causing actuator lug 4 on actuator 2, press contact arm 5 closing contacts 8 and 9 which provides an electrical current path from battery to the load. And, also closing contacts 10 and 11 providing an electrical path from the battery to the voltage level control sensing interrupting circuit effecting the energizing of relay K1 relay. These functions may overlap or either lug 4 or relay K1 may achieve the same result depending on the length of lug 4.

FIG. 5

Shows 2 actuator in the full right position with ignition switch 32 in 'on' position, continuing to allow actuator lug 4 to hold contact arm 5 down, locking contacts 8 and 9 together, providing a locked electrical current pathway from the battery to the load and actuator 2 also having actuator lug 7 forcing auxiliary contact arm 6 upward, opening contacts 10 and 11 closing off electrical current to the voltage level control de-energizing K1 relay. Further turning of the key to the start position of key lock 30 pushing further down on rod 31 compresses spring 35 between contact arm 3 and actuator 2 to allow this excessive movement without damage to mechanism enclosure 1.

Figure 5:
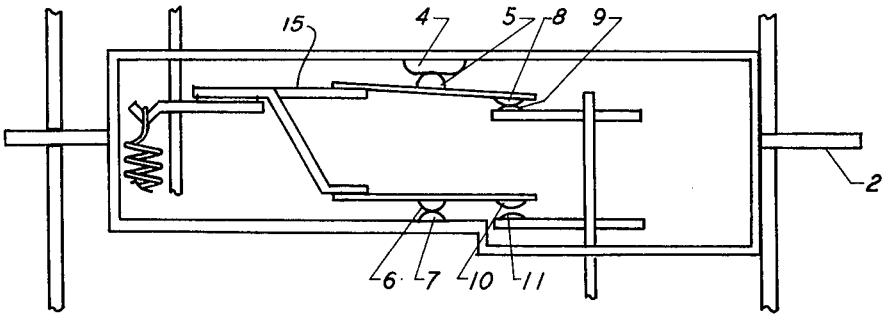

Returning from the 'on' position shown in FIG. 5 towards the 'off' position shown in FIG. 3 the position of FIG. 4 is passed through allowing the closure of contacts 10 and 11, re-establishing the electrical current path to the voltage level circuit, re-energizing K1 relay which then will be capable of holding contacts 8 and 9 together is the preferable way described.

Further turning back key-lock 30 to full 'off' position withdraws the actuator back to FIG. 3 position. However, even though actuator lug 4 no longer presses down on contact arm 5 contacts 8 and 9 and 10 and 11 are held together by magnetic forces until the battery decays to a pre-set level allowing all contacts 8, 9, 10, and 11 to open.

I claim:

1. In a vehicular key operated electrical system normally connecting a vehicular electrical load to the vehicular battery via an electrical current path wherein the key has at least an "on" and an "off" position, switching apparatus for opening and closing said path in response to pre-determined conditions including key position and battery voltage level comprising, in combination:

first actuator means in said path for opening said path and for closing said path;

a circuit comprising magnetic voltage sensing means and second actuator means for opening and closing said circuit;

mechanical means movable in response to key position to actuate said first actuator mans and said second actuator means; said mechanical means mechanically locking the first-mentioned actuator means closing said path when the key is in the "on" position;

said mechanical means actuating said second actuator means when the key is moved from "on" to "off" to magnetically maintain said first actuator means actuated via said magnetic voltage sensing means; and, said voltage sensing means relieving said magnetic maintaining when the battery voltage drops to said pre-determined voltage level.

2. The switching apparatus of claim 1 wherein said switching apparatus is mounted in a vehicle in spaced relation to the key, and said mechanical means translates key position and movement to said apparatus.

3. The apparatus of claim 2 further comprising yieldable means interposed between said mechanical means and the switching apparatus to yield when the key is switched to a START position without affecting the switching apparatus.

4. The apparatus of claim 1 wherein said voltage sensing means comprises a relay coil, a Zener diode and a potentiometer in series connection.

5. The apparatus of claim 1 wherein said switching apparatus comprises a housing for connection to the steering column of a vehicle, a movable lug carrier mounted within said housing; and said first actuator means and second actuator means each including contacts movable by said lug carrier in response to key position.

6. The apparatus of claim 5 wherein the first and second actuator means comprise a pair of bifurcated arms spaced apart at corresponding ends and respectively carrying a contact of the first actuator means and the second actuator means; a pair of fixed contacts for cooperation respectively with said contacts carried by the arms to provide switching; said lugs selectively moving said arms in response to key movement.

7. The apparatus of claim 6 wherein said voltage sensing means comprises a relay for magnetically moving said contact carrying arms.

* * * * *